United States Patent [19]

Masoncup et al.

[11] Patent Number: 4,811,578

[45] **Date of Patent: * Mar. 14, 1989**

[54] PADLOCK WITH TAMPER-ACTUATED AUDIBLE AND/OR INAUDIBLE ALARM

[75] Inventors: John F. Masoncup, Mount Prospect; Thomas J. Mayer, Hoffman Estates, both of Ill.

[73] Assignee: John F. Masoncup, Mount Prospect, Ill.

[ * ] Notice: The portion of the term of this patent subsequent to Dec. 3, 2002 has been disclaimed.

[21] Appl. No.: 692,516

[22] Filed: Jan. 18, 1985

Related U.S. Application Data

[63] Continuation-in-part of Ser. No. 524,152, Aug. 18, 1983, Pat. No. 4,556,872.

[51] Int. Cl.[4] ..... E05B 67/22; E05B 39/00; E05B 45/06

[52] U.S. Cl. ..... 70/38 B; 70/439; 70/53; 70/38 A; 340/542

[58] Field of Search ..... 70/38 B, DIG. 49, DIG. 51, 70/18, DIG. 54, 53, 38 A, 38 C, 25, 432, 435, 434, 439; 340/542, 543, 568; 200/61.64

[56] References Cited

U.S. PATENT DOCUMENTS

| | | | |
|---|---|---|---|
| 2,070,012 | 2/1937 | Jacobi | 70/38 B |
| 3,597,944 | 8/1971 | Litvin | 70/53 |
| 3,772,645 | 11/1973 | Odenz | 70/18 |
| 3,824,540 | 7/1974 | Smith | 340/63 |
| 3,824,541 | 7/1974 | Nolan | 340/65 |
| 3,828,310 | 8/1974 | Miller | 340/65 |
| 3,879,721 | 4/1975 | Yereance | 340/65 |
| 3,993,987 | 11/1976 | Stevens | 70/49 |
| 4,057,986 | 11/1977 | Zolke et al. | 70/DIG. 49 |
| 4,546,345 | 10/1985 | Naito | 70/DIG. 51 |
| 4,556,878 | 12/1985 | Masoncup et al. | 70/439 |

FOREIGN PATENT DOCUMENTS

| | | | |
|---|---|---|---|
| 687974 | 6/1964 | Canada | 70/38 B |
| 962079 | 2/1975 | Canada | 70/38 B |
| 919315 | 5/1947 | France | 70/38 B |

*Primary Examiner*—Gary L. Smith
*Assistant Examiner*—Vinh Luong
*Attorney, Agent, or Firm*—Marshall, O'Toole, Gerstein, Murray & Bicknell

[57] ABSTRACT

A padlock comprises a battery-powered, built-in alarm which operates when the padlock's shackle is severed or forced open. The battery and alarm can be tested by opening the lock with a key, rotating the short leg of the shackle away from the lock body and then depressing the shackle, or optionally, by depressing the short leg. The alarm is turned on in response to the momentary closing of a switch when one shackle leg moves outwardly upon severance or forcible opening. The alarm may be an audible signal or an inaudible signal transmitted as a radio wave to a remote receiver at which an audible or visible signal is actuated. The audible signal generated at the lock escapes from the lock body through sound ports. Both audible and inaudible signals may be generated at the lock simultaneously.

41 Claims, 3 Drawing Sheets

PADLOCK WITH TAMPER-ACTUATED AUDIBLE AND/OR INAUDIBLE ALARM

RELATED APPLICATION

This is a continuation in part of U.S. application Ser. No. 524,152 filed Aug. 18, 1983 and issued as U.S. Pat. No. 4,556,872 on Dec. 3, 1985, and the disclosure thereof is incorporated herein by reference.

BACKGROUND OF THE INVENTION

The present invention relates generally to locks and more particularly to a padlock with an alarm which operates when someone tries to violate or tamper with the padlock.

Generally, a padlock comprises a body and a shackle having long and short legs. The shackle is mounted for reciprocal movement relative to the body between a closed, depressed position in which both legs are in the body and an extended, open position in which the short leg is outside the body. Located within the body is a latch for engaging one leg of the shackle when the shackle is in its closed position, and this prevents movement of the shackle to its open position. In order to move the shackle from its closed to its open position, the latch must be disengaged, and the padlock includes a lock mechanism operable to disengage the latch. The lock mechanism may be key operated or combination-operated in an authorized manner. The padlock is typically composed of a hard metal such as steel.

Padlocks are used for securing possessions or property to prevent theft or trespassing. It is not uncommon, however, for someone intent on theft or trespassing to tamper with the padlock in an attempt to open it in an unauthorized manner, either by severing the shackle or by forcing it into an open position or the like. To deter a thief or the like from tampering with the padlock, it has been proposed in the past to provide the padlock with an integral alarm system which sounds an alarm when the thief violates or tampers with the padlock.

A padlock having an integral alarm system is disclosed in Stevens, U.S. Pat. No. 3,993,987. Such a system conventionally includes, in addition to the audible alarm sounding device, a battery for energizing the audible alarm sounding device and an electrical circuit having switches connecting the audible alarm sounding device to the battery for actuating the audible alarm sounding device when a violation occurs or an attempt is made to tamper with the padlock.

Because such an alarm system is powered by a battery, and because a battery can die, one should be able to test the battery to determine whether it still has sufficient power to operate the alarm. Provision for testing the battery is made in the system disclosed in the above-noted Stevens patent, but the test is complicated, bothersome and otherwise undesirable.

Moreover, because all batteries eventually wear out and must be replaced, access must be provided to the battery within the padlock to permit removal and replacement of the battery. Such a provision, however, gives a thief the opportunity to gain access to the battery to remove it and deactivate the alarm.

In addition, in Stevens, there is no special provision for sound emission from the padlock when the audible alarm sounds.

SUMMARY OF THE INVENTION

The present invention constitutes a padlock with a tamper actuated alarm and which comprises structure and circuitry which permits the battery to be tested by merely depressing the shackle after the padlock has been unlocked in an authorized manner, in one embodiment, or when the padlock is in its closed, locked condition, in another embodiment.

The alarm, upon actuation, may emit an audible sound which can be heard locally in the neighborhood of the padlock, or the alarm may emit an inaudible signal in the form of a radio transmission which may be received locally or at a remote location where the inaudible signal activates an audible alarm or a light or other visual indicator; or the alarm may emit a combination of such audible and inaudible signals.

The padlock also comprises structure which permits removal of the battery only by a person who can open the lock in an authorized manner, e.g. with a key, for a key-operated lock, or by employing the correct combination in a combination lock.

The padlock contains structure and circuitry which actuates or turns on the alarm when the lock has been violated but maintains the alarm in an off condition during normal, authorized operation of the lock. There is an electrical circuit having first and second switches and structure for maintaining the first switch in an open position and the second switch in a closed position when the shackle is in its depressed position and the short leg of the shackle is inside the lock body. The electrical circuit will actuate the alarm to its on condition and maintain the alarm in its on position in response to the momentary closure of the first switch while the second switch remains closed. The lock comprises structure responsive to the movement of the normally unengaged other shackle leg from its depressed to its extended position for momentarily closing the first switch.

The padlock body includes sound ports through which the audible alarm signal is emitted, to increase the radius of the area in which the audible signal can be heard.

To assure maximum dissemination of the audible alarm signal when the lock has been violated, the padlock includes structure which defines a port for the alarm sound when the other shackle leg is outside of the lock body, as will occur when the shackle is severed or when the other shackle leg is forced out of the lock body.

Other features and advantages are inherent in the structure claimed and disclosed or will become apparent to those skilled in the art from the following detailed description in conjunction with the accompanying diagramatic drawing.

Figure 1:
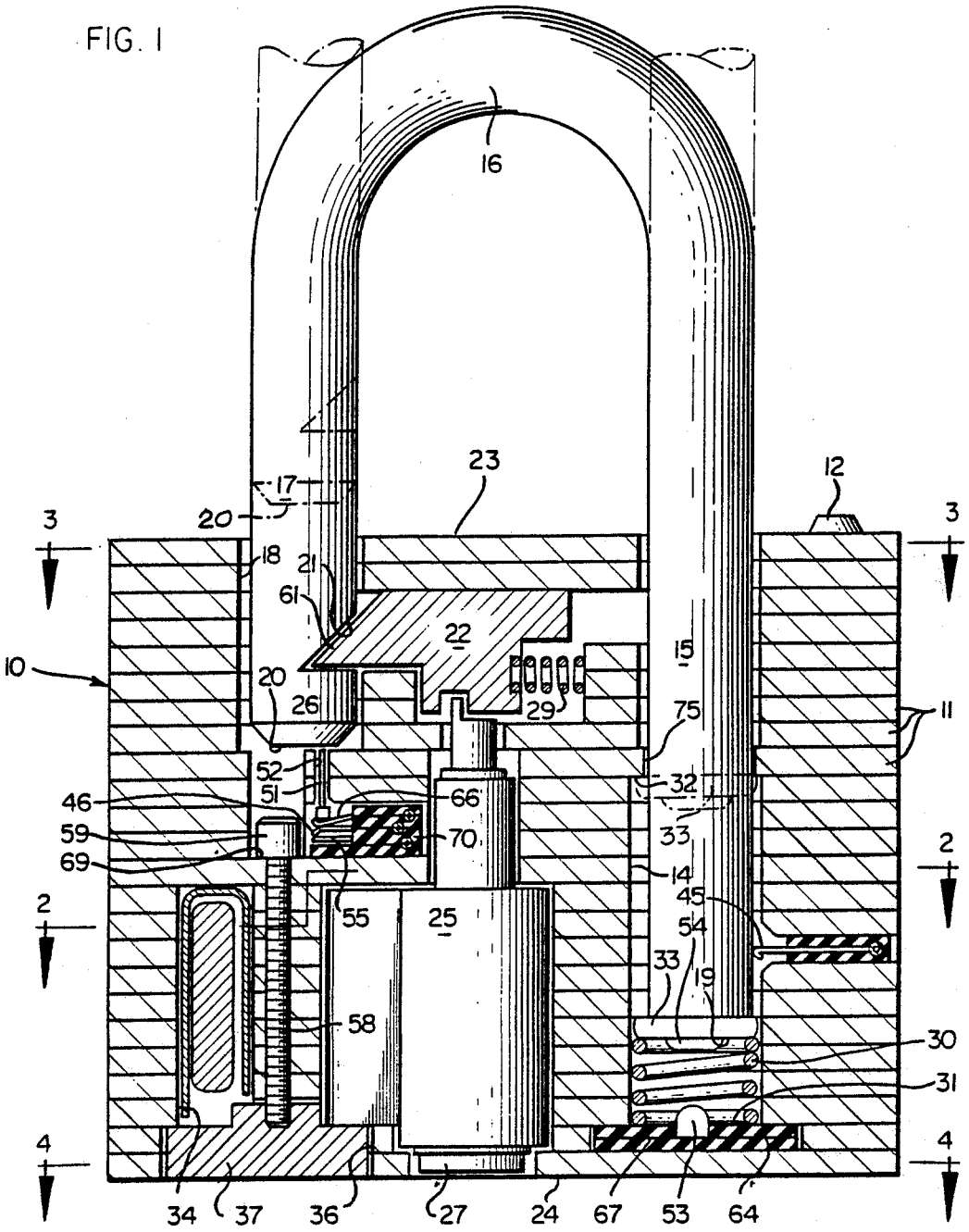
FIG. 1 is a side elevation, in section, of a padlock with a tamper actuated alarm in accordance with an embodiment of the present invention.

Referring initially to FIG. 1, indicated generally at 10 is a padlock body composed of a series of laminations 11,11 held together by a plurality of rivets, one of which is shown at 12. Padlock body 10 has a pair of opposite ends, 23, 24. Extending inwardly from end 23 is an elongated, receiving channel 14 within which is normally received the long leg 15 of a shackle 16 having a short leg 17 which, when the shackle is in a locked position, is received within a channel 18 extending inwardly into padlock body 10 from end 23. Shackle 16 is mounted for reciprocal movement relative to body 10, between an extended, open position, in which short shackle leg 17 is outside body 10, and a plurality of depressed positions for the shackle, one of which is shown in FIG. 1. In the embodiment of FIG. 1, shackle long leg 15 normally remains within its receiving channel 14 in all positions of the shackle.

Located near the end 20 of short leg 17 is a notch 21 for receiving the end 61 of a latch 22 urged by a coil spring 29 toward channel 18. Latch end 61 engages notch 21 on short leg 17 when shackle 16 is in a first of its depressed positions, shown in FIG. 1, with short leg 17 inside channel 18. Located adjacent latch 22 is the inner end 26 of a lock mechanism 25 operated by a key insertable into a key slot (not shown) located in the outer end 27 of lock mechanism 25, adjacent lock body end 24.

Lock mechanism 25 is of conventional construction normally found in padlocks and need not be described here. When the lock mechanism is operated by turning a key in the slot, latch 22 is moved away from channel 18 causing latch end 61 to be withdrawn from engagement with notch 21, against the urging of latch spring 29. The structure which moves latch 22 in response to the operation of lock mechanism 25 is conventional in nature and need not be described here.

When latch 22 is disengaged from short shackle leg 17, shackle 16 is urged outwardly to its extended, open position by structure now to be described. Channel 14 for long shackle leg 15 has an inner end 31 at which is located a coil spring 30 which engages the inner end 19 of long leg 15. When shackle 16 is in the closed position illustrated in FIG. 1, spring 30 normally urges shackle 16 towards its open, extended position, but such movement is restrained by the engagement of latch 22 with notch 21 in short leg 17. Upon disengagement of latch 22 from notch 21, coil spring 30 pushes shackle 16 to its open, extended position. In that position, all of short leg 17, including its free end 20, is located totally outside of padlock body 10 (dash-dot lines in FIG. 1).

Located adjacent inner end 19 on long leg 15 is a flange 33 extending radially outwardly from leg 15. Outward movement of shackle 16, under the urging of coil spring 30, is limited by the engagement of flange 33 with stop structure 32 extending into channel 14 from one of the laminations 11 (dash-dot lines in FIG. 1). The engagement of flange 33 with stop structure 32 determines the extended position of shackle 16. When the shackle is in its open, extended position, it may pivot about the axis of long leg 15 between a first pivotal disposition in which short shackle leg 17 is aligned with its receiving channel 18 and a second pivotal disposition (e.g. 90° displaced from the first pivotal disposition) in which the short shackle leg is completely clear of the lock body.

Figure 5:
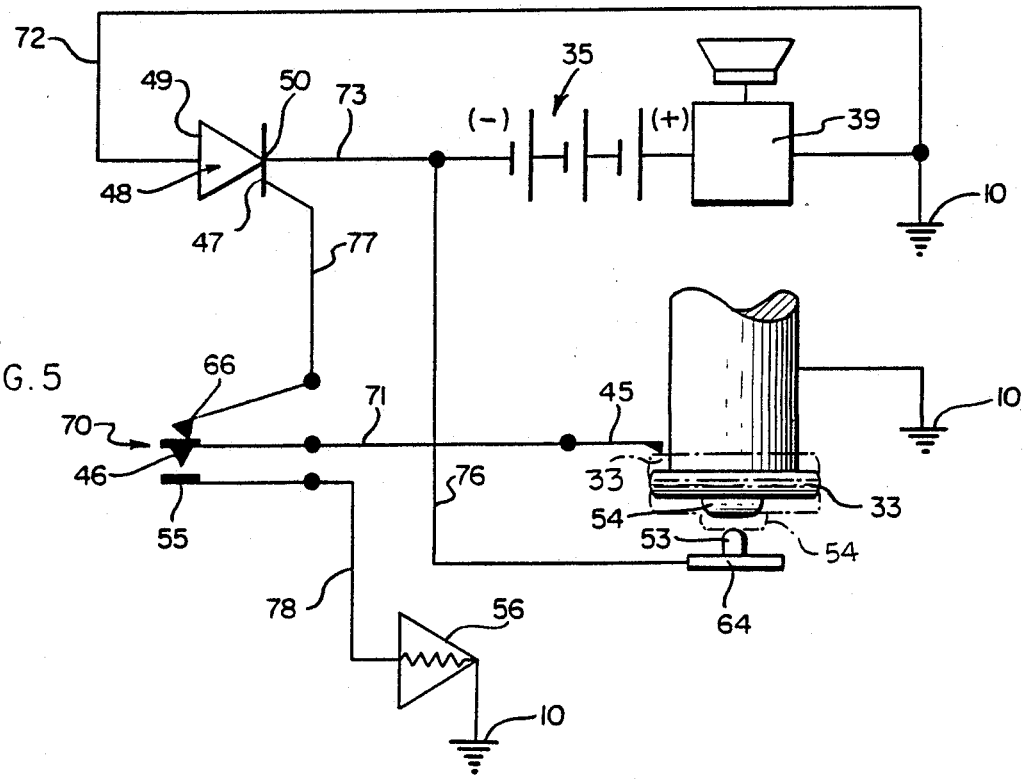
FIG. 5 is a schematic diagram illustrating an electrical circuit for the alarm system in the padlock.

Located within body 10 is an alarm system which will now be described with reference to FIGS. 1–2 and 5. Located inwardly of padlock body end 24 is a compartment 34 for receiving a battery unit 35. Communication with compartment 34 is an entry 36 closed by a removable cap 37 about which more will be described later. Battery unit 35 comprises a plurality of batteries located within a U-shaped housing 38 comprising a printed circuit board which electrically connects together all of the batteries to function as a unit. Board 38 is composed of non-electrically conductive material on which has been applied an electrically conductive printing to connect the batteries together in series.

Figure 2:
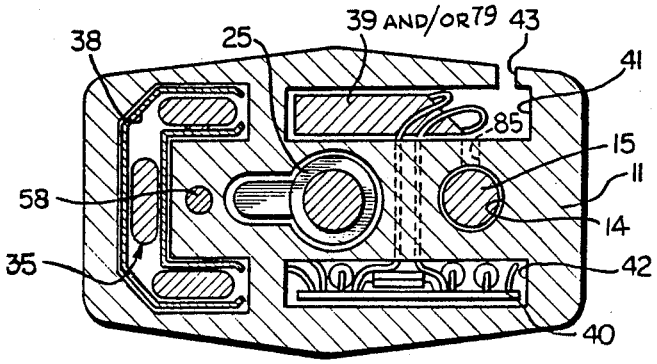
FIG. 2 is a sectional view taken along line 2—2 in FIG. 1.
Figure 3:
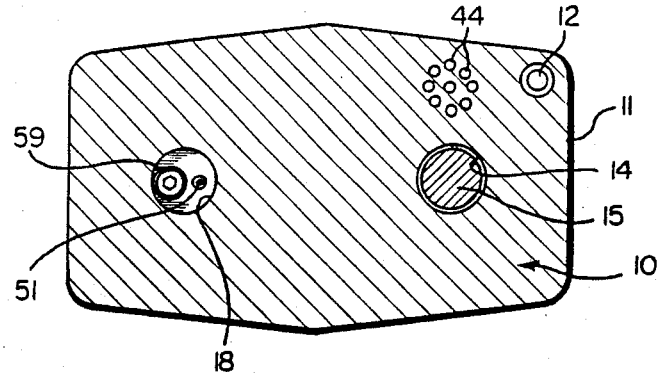
FIG. 3 is a sectional view taken along line 3—3 in FIG. 1.
Figure 4:
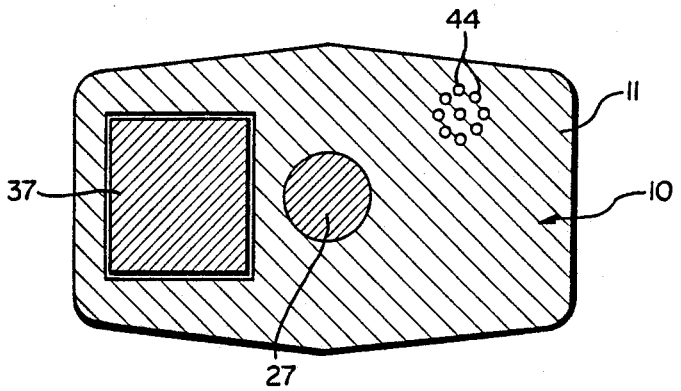
FIG. 4 is a sectional view taken along line 4—4 in FIG. 1.

Referring to FIG. 2, also constituting part of the electrical circuit are a signal emitting element in the form of a transducer 39 and a circuit board 40 each contained within respective housings 41, 42 formed in laminations 11, 11. When transducer 39 is activated, it generates an audible alarm sound which exits from the lock body through side sound ports 43 communicating with housing 41 and transducer 39. Side sound ports 43 are located in intermediate laminations 11, 11 of lock body 10. As shown in FIGS. 3–4, other laminations 11, 11 contain a plurality of sound ports 44 for conducting sound from transducer housing 41 to opposite ends 23, 24 of lock body 10 from which the sound may escape through openings 44.

In lieu of transducer 39, or in combination therewith, the signal emitting element may be a radio transmitter for emitting an inaudible radio signal which may be received locally or at a remote location where the inaudible signal activates an audible alarm or a light or other visual indicator. The embodiment described herein refers to the signal emitting element as a transducer; however, it should be understood that when reference is made to a transducer, a radio transmitter or a combination of transducer and radio transmitter may be employed in lieu of the transducer, except that at least a transducer must be employed when the lock body includes sound ports.

Referring again to FIG. 2, the alarm is actuated in response to a violation of the padlock which may be either a severance of shackle 16 or a forced removal of long shackle leg 15 from its receiving channel 14. Referring now to FIGS. 1 and 5, that part of the electrical circuit for actuating the signal emitting element, viz. transducer 39 in this embodiment, will now be described in greater detail. Lock body 10 is grounded in the electrical circuit. Long leg 15 is grounded during movement of shackle 16 by virtue of the contact between leg 15 and parts of laminations 11, 11 defining the walls of channel 14, e.g. the inside surface 75 of stop 32. This grounding contact between long leg 15 and lock body 10 is constant and continuous and occurs while the long leg is stationary (passive contact) and while it is moving (sliding contact). As an alternative, the interior of channel 14 may be provided with a conductive wiper element (not shown) which is in constant contact with long leg 15 to connect the latter to ground.

There is a first switch having a resilient element 45 extending into channel 14 alongside long leg 15 but normally not touching the long leg. As a result, the first switch is normally open, and it is closed by engagement of element 45 with flange 33 which extends radially outwardly on long leg 15 at end 19. Referring to FIG.

5, first switch element 45 is electrically connected to a resilient element 66 connected to the gate electrode 47 of a silicon rectifier 48 whose anode 49 and cathode 50 are connected across battery unit 35 in the circuit containing alarm-sounding transducer 39. Rectifier 48 is located on circuit board 40 and comprises a latch circuit activated when current flow through the rectifier is at a predetermined, sufficient level. There is normally insufficient current flow through rectifier 48 to activate the latch.

Second switch 46, 66 is kept closed when shackle 16 is in the depressed, closed position of FIG. 1. More particularly, inner end 20 of short leg 17 presses downwardly on the outer end of a pin 51 guided within a channel 52 and having an inner end which presses element 66 of the second switch against element 46 to close the second switch when the shackle is in its depressed, closed position of FIG. 1. When the shackle is moved to its extended, open position, the springable nature of resilient element 66 causes it to move away from element 46, pushing pin 51 axially outwardly within channel 52 and opening the second switch.

Outward movement of long leg 15 closes the first switch 33, 45 momentarily (dash-dot lines in FIG. 5), and if the second switch at 46, 66 is closed at the time when the first switch closes, a circuit is formed connecting gate electrode 47 on silicon rectifier 48 to the positive side of battery 35. This allows sufficient current to flow between the anode and cathode of the rectifier to activate the latch. This current flow through rectifier 48 also turns on alarm-sounding transducer 39, and activation of the latch maintains alarm sounding transducer 39 in an on condition. Once current flow through the latch circuit of rectifier 48 is at an activating level, it stays latched except under certain conditions to be described below. The opening of first switch 33, 45 after its momentary closure does not turn off the alarm once the latch has been activated. The latch circuit may be of conventional design.

Second switch 46, 66 is closed when short leg 17 is inside channel 18 in the depressed position shown in FIG. 1. The unlocking of lock mechanism 25 with a a key disengages latch 22 from notch 21 in short leg 17 causing both legs of the shackle to be propelled outwardly by coil spring 30, and this immediately opens second switch 46, 66 before first switch 33, 45 closes so that no alarm is sounded when the lock is opened in an authorized manner. Severing or forcing the shackle leaves second switch 46, 66 closed because short leg 17 remains in the depressed position of FIG. 1 while long leg 15 moves outwardly. In the case of a severance, long leg 15 is propelled outwardly by coil spring 30.

In the embodiment of FIG. 1, once the alarm has been turned on it can be turned off by a sequence of steps which includes depressing long leg 15 inwardly, against the urging of spring 30, to a second depressed position to close a third switch 53, 54 at the inner end 31 of channel 14 (dash-dot lines in FIG. 5) followed by a release of the long leg to open the third switch. Normally, a permanent shut-off cannot occur unless short leg 17 is first moved outside of and pivoted away from lock body 10, because if short leg 17 is inside the lock, it will be engaged by latch 22 before long leg 17 can be depressed sufficiently to close the third switch. However, moving the short leg outside the lock body requires authorized operation of the lock, as with a key.

If shackle 16 has been severed, the third switch can be closed because long leg 15 or its severed stub will no longer be structurally connected to short leg 17. In such a case, however, a subsequent release of the severed, depressed long leg will only momentarily shut-off the alarm which will then be re-actuated, as described below.

The third switch comprises one contact element 53 located at inner end 31 of channel 14 and another contact element 54 at the inner end 19 of long leg 15. Contact element 53 is connected by a wire 76 to the negative electrode of battery 35 between the latter and latch circuit 48. Because contact element 54 is on the long shackle leg, it is connected through electrical ground to the positive electrode of the battery. Closing third switch 53, 54 completes a circuit connected to both sides of the battery, and this drains away from the latch circuit enough current to drop the current flow through the latch circuit below the level necessary to keep the latch circuit operating. As long as the third switch 53, 54 is closed, the alarm will continue to sound because the third switch completes a circuit comprising battery 35 and alarm-sounding transducer 39. Thereafter, releasing the depressed long leg will open the third switch, and turn off the alarm, but if second switch 46, 66 is still closed when the depressed long leg is released to open the third switch (as would be the case when the shackle has been severed), the alarm will be immediately reactuated because of the momentary closing of first switch 43, 45 as the released long leg moves outwardly under the urging of coil spring 30.

Coil spring 30 rests on multi-layer pad 64 composed of electrical insulating material. Switch element 53 extends upwardly through pad 64 from a thin, film-like, electrically conductive layer 67 (FIG. 1) sandwiched between non-conductive layers of pad 64 and connected to wire 76.

Once actuated, the alarm in the embodiment of FIG. 1 can only be permanently shut off by an authorized person who opens the lock with a key, to open second switch 46, 66, then pivots the short leg away from the lock body and then depresses long leg 15 to close the third switch, followed by the release of the long leg to open the third switch.

Once the alarm has begun by activating latch circuit 48, the latch circuit will remain latched allowing the alarm to continue even if second switch 46, 66 is opened. The latch circuit can only be rendered inoperable by dropping the current flow through the latch circuit below a predetermined level, and this condition will not be produced merely by opening the second switch. It can only be produced by closing the third switch.

Closing the third switch can also be used to test the battery and the rest of the alarm circuit. To put the circuit in a test condition, the lock must be opened with a key, and short leg 17 must be withdrawn from the lock body and rotated out of alignment with the lock body (e.g., a 90° rotation). Then, long leg 15 can be manually depressed sufficiently to close the third switch at 53, 54, causing the alarm to begin by the flow of current through a circuit which completely bypasses latch circuit 48 (see FIG. 5). Thereafter, release of the depressed long leg opens the third switch, and although outwardly moving long leg 15 then momentarily closes first switch 33, 45, this will not reactuate the alarm because second switch 46, 66 is open due to short leg being outside the lock body. As previously noted, closing of first switch 33, 45 will not activate the alarm unless the second switch is closed at the same time.

The lock may also contain an optional, additional circuit comprising a normally open fourth switch comprising an element 55 connected to electrical ground and located directly below resilient element 46 of the second switch so that further depression of short leg 17 within channel 18 beyond its first depressed position will close a fourth switch defined by elements 46 and 55 while continuing to maintain second switch 46, 66 in its normally closed position. Fourth switch 46, 55 is closed by depressing the shackle to a third depressed position which is more depressed than the shackle's first depressed position, in which only second switch 46, 66 is closed, but less depressed than the shackle's second depressed position in which third switch 53, 54 is closed.

There is enough play in the engagement of latch 22 in notch 21 on the short leg to allow the shackle to be slightly further depressed, against the urging of spring 30, to cause the short leg to close the fourth switch, but not enough to cause long leg 15 to close the third switch 53, 54.

Between fourth switch element 55 and ground is a buffer resistance 56 (FIG. 5) located on circuit board 40. When fourth switch 46, 55 is closed, it completes a circuit which connects gate electrode 47 of rectifier 48 to ground and thereby through the alarm components to the positive electrode on the battery, the negative electrode of which is connected to cathode 50 of the rectifier. Unlike the situation which prevails when the gate electrode is connected to ground through first switch 33, 45, insufficient current flows through latch circuit 48 to activate it to a latched condition when gate electrode 47 is connected to ground through fourth switch 46, 55 and buffer resistance 56, but there is current flow through transducer 39 to sound the alarm. Then, when the shackle is released from its third depressed condition, short leg 17 moves outwardly very slightly but enough to open fourth switch 46, 55 and turn off the alarm. Therefore, the circuit containing the fourth switch can be used to test the battery and the alarm-sounding components without opening the lock with a key, etc., as is required when testing by closing third switch 53, 54 below long leg 15.

Switch elements 46, 55, 66 are all physically assembled into a unitary switch assembly 70 (FIG. 1) mounted within lock body 10 adjacent the inner end 69 of the short leg's receiving channel 18. As shown in FIG. 5, wires 77, 78 run from switch assembly 70 to circuit board 40 to connect switch elements 66 and 55 to gate electrode 47 and buffer resistance 56 respectively. Another wire 71 runs from switch element 46 on assembly 70 to first switch element 45. Wires 72, 73 respectively connect the anode 49 and cathode 50 of rectifier 48 to transducer 39 and the cathode of battery 35 respectively.

Figure 7:
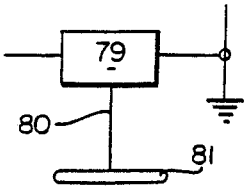
FIG. 7 is a fragmentary schematic diagram illustrating an embodiment of signal emitting element differing from that illustrated in FIG. 5.

Referring now to FIG. 7, the alarm circuit may contain as a signal emitting element, in lieu of transducer 39 (FIG. 5), a radio transmitter 79 connected by an insulated wire 80 extending through an opening in lock body 10 to an antenna 81 disposed around the exterior of the lock body, e.g. embedded in a polyurethane skirt (not shown) surrounding lock body 10 adjacent end 24 thereof. Radio transmitter 79 is of conventional construction and is commercially available. In another embodiment, the signal emitting element may constitute a combination of both transducer 39 and radio transmitter 79. In all embodiments, the signal emitting element is activated, tested, turned on and turned off as described above in connection with transducer 39.

As generally noted above, the lock comprises structure which prevents removal of battery cap 37 and which renders the removal-preventing structure accessible to an authorized person only. More particularly, referring to FIG. 1, entry 36 to battery compartment 34 is closed by removable cap 37. Engaging the inner end of cap 37 is one end of a threaded member 58 having, at its other end, a head 59 located at inner end 69 of the short leg's receiving channel 18. Member 58 is a removable fastener which can be disengaged from cap 37 solely by engaging a tool in fastener head 59. The engagement of cap 37 by fastener 58 prevents removal of cap 37 from entry 36. Fastener head 59, as well as the rest of fastener 58, is accessible solely through receiving channel 18. However, short leg 17 blocks access to fastener 58 when the short leg is in channel 18. Therefore, one may not remove fastener 58 until short leg 17 is outside the lock, and this can be accomplished only by authorized operation of the lock, e.g. with a key. Absent disengagement of fastener 58 from cap 37, cap 37 cannot be removed and access to battery compartment 34 is not possible.

Figure 6:
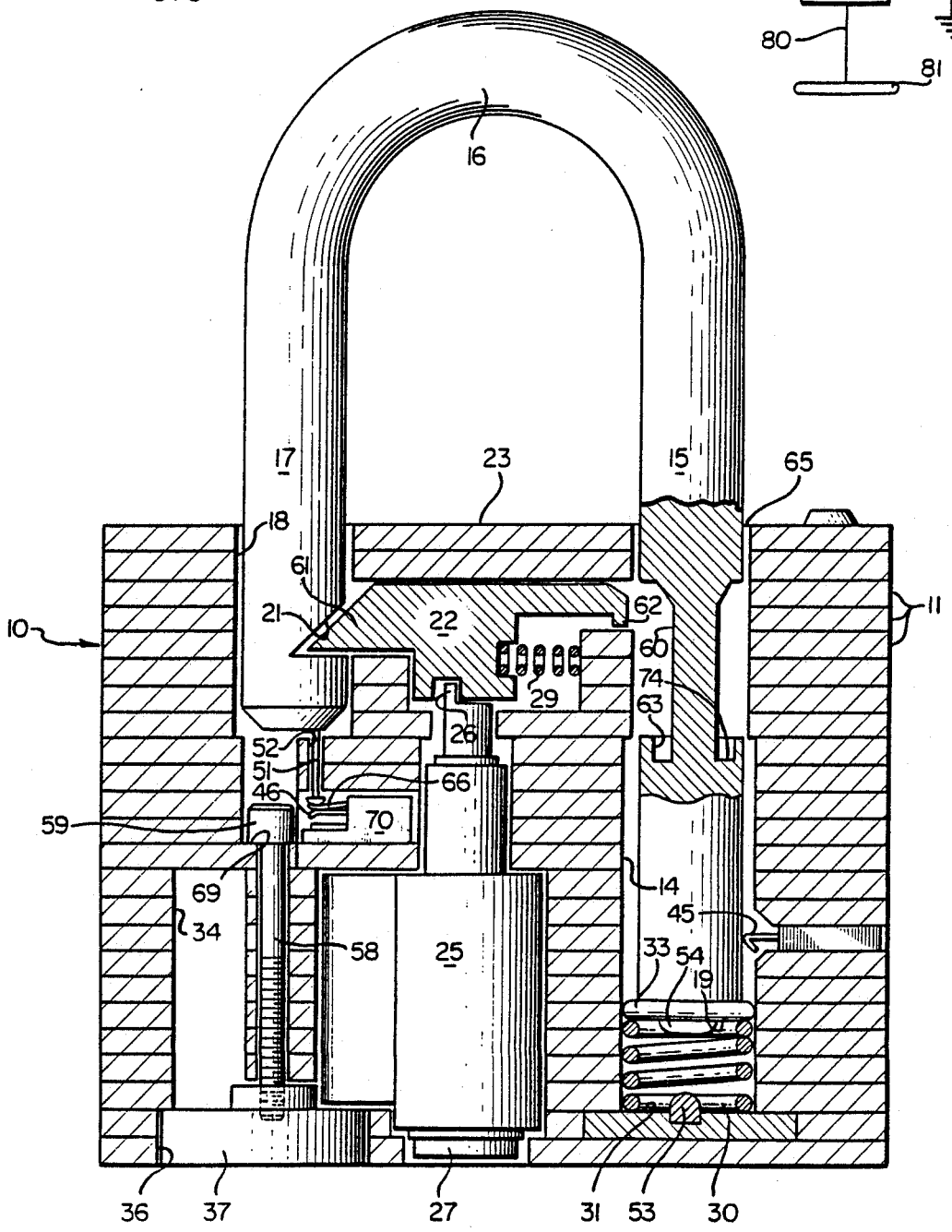
FIG. 6 is a side elevation, in section, similar to FIG. 1, showing another embodiment of a padlock in accordance with the present invention.

With respect to the embodiment illustrated in FIGS. 1–4, it is possible that one who seeks to violate the lock could attempt to plug up, with gum or putty or the like sound port 43 in the side of the lock body and sound openings 44, 44 in the ends of the lock body, so as to mute the sound of the audible alarm once the lock has been violated. FIG. 6 depicts an embodiment of the present invention which eliminates the possibility that the audible alarm may be muted by a potential violator.

In the embodiment shown in FIG. 6, long leg 15 has an elongated, peripheral indentation 60 located in an intermediate portion of the long leg. A lip 63 is disposed around the periphery of indentation 60 and extends in an axially outward direction at the inner end 74 of the indentation. Latch 22 comprises, as in the embodiment of FIG. 1, first engaging means 61 for engaging notch 21 on short leg 17. In addition, in the embodiment of FIG. 6, latch 22 comprises second engaging means 62 for engaging lip 63 when the shackle is in its extended, open position. Latch 22 is mounted for reciprocal movement between a first position wherein the latch is engageable with short leg 17 but not with long leg 15 and a second position wherein the latch is engageable with long leg 15 but not short leg 17. Coil spring 29 normally urges latch 22 to its first position.

When lock mechanism 25 is operated with a key by an authorized operator, latch 22 is moved to its second position, against the urging of coil spring 29. As the latch moves toward its second position it is disengaged from its engagement with short leg 17, and coil spring 30 urges the entire shackle 16 towards its extended open position. In the embodiment of FIG. 6, the extended open position for shackle 16 is determined by the engagement of second engaging means 62 on latch 22 with lip 63 at the inner end of indentation 60 on long leg 15. When the shackle is depressed from its extended open position toward one of its depressed positions, lip 63 is disengaged from the latch's second engaging means 62, and coil spring 29 urges latch 22 to its first position.

In the embodiment of FIG. 6, channel 14, which receives long leg 15, is in communication at 85 with recess 41 which contains alarm sounding transducer 39 (FIG. 2). Channel 14 has an open end 65 through which long leg 15 is received into the channel. In a situation wherein long leg 15 would be totally outside of channel 14, that channel 14 and its open end 65, because they are in communication with transducer-containing recess 41, define a sound port for the audible alarm.

In the embodiment of FIG. 6, long leg 15 will be moved totally outside of channel 14 when there is a violation of the lock, either by severing shackle 16 or by forcibly removing long leg 15 from channel 14. When a violation occurs in either such manner, there has been no authorized operation of lock mechanism 25, so that latch 22 remains in its first position and there is thus no opportunity for the latch's second engaging means 62 to engage with lip 63 on indentation 60 in long leg 15. Accordingly, severance of shackle 16 will cause coil spring 30 to fully eject the stub of long leg 15 entirely out of channel 14, thereby creating the aforementioned open sound port. Where a violation is in the form of a forced removal of the long leg from channel 14, the sound port is opened when the long leg's inner end 19 is forced outwardly through end 65 of the channel. In either case, movement of the long leg in an outward direction causes a momentary closing of first switch 33, 45 while second switch 46, 66 remains closed, thereby actuating alarm sounding transducer 39 and activating latch circuit 48.

In this embodiment, once the alarm has been actuated and the latch circuit activated, the alarm can only be shut off by inserting an elongated conductor element, such as piece of rod or the like, into channel 14 until it contacts fourth switch element 53 and then grounding the elongated conductor on a side wall of channel 14. The effect is to create a circuit which bypasses latch circuit 48, reducing the current flow therethrough below the activating level of the latch circuit. When the elongated conductor element is then disengaged from switch element 53, the alarm stops sounding.

The foregoing detailed description has been given for clearness of understanding only, and no unnecessary limitations should be understood therefrom, as modifications will be obvious to those skilled in the art.

We claim:

1. A padlock with a tamper alarm, said padlock comprising:

a body;

a shackle having a long leg and a short leg;

means mounting said shackle for reciprocal movement thereof relative to said body, between an extended, open position, in which said short shackle leg is outside the body, and a plurality of depressed position for the shackle;

means in said body for receiving each of said shackle legs;

means normally urging said shackle to its extended position;

latch means for engaging one of said shackle legs when the shackle is in a first of its depressed positions and said short leg is inside the lock body;

lock means operable to disengage said latch means from said one shackle leg;

alarm means actuable to emit an alarm signal;

and means, responsive to the depression of the shackle to another of its depressed positions more depressed than said first depressed position, for actuating said alarm means as a test of its operativeness.

2. A padlock as recited in claim 1 wherein said alarm-actuating means comprises:

means for emitting said alarm signal for so long as the shackle is maintained in said other depressed position.

3. A padlock as recited in claim 1 and comprising:

means mounting the shackle for pivotal movement, when the shackle is in its extended, open position, between a first disposition in which said short leg is aligned with its receiving means in the lock body and a second disposition in which said short leg is clear of said body;

said alarm-actuating means comprising means associated with said long shackle leg for actuating said alarm when the shackle is depressed to a second depressed position, more depressed than said first depressed position, while said short leg is outside the shackle body and the shackle is in its second pivotal disposition.

4. A padlock as recited in claim 3 and comprising:

means associated with the short shackle leg for actuating said alarm when the shackle is depressed to a third depressed position, more depressed than said first depressed position but less depressed than said second depressed position, while the shackle is in its first pivotal disposition.

5. A padlock as recited in claim 4 and comprising:

means on said one leg cooperating with said latch means to accommodate movement of said shackle between its first and third depressed positions while maintaining the engagement of said one leg by said latch means.

6. A padlock as recited in claim 4 wherein:

said means associated with the short shackle leg comprises switch means located in the receiving means for the short leg.

7. A padlock as recited in claim 3 wherein:

said means associated with said long shackle leg comprises switch means located in the receiving means for the long leg.

8. A padlock as recited in claim 1 and comprising:

means mounting the shackle for pivotal movement, when the shackle is in its extended, open position, between a first disposition in which said short leg is aligned with its receiving means in the lock body and a second disposition in which said short leg is clear of said body;

said alarm-actuating means comprising means associated with the short shackle leg for actuating said alarm when the shackle is depressed to said position more depressed than said first depressed position, while the shackle is in its first pivotal disposition.

9. A padlock as recited in claim 8 and comprising:

means on said one leg cooperating with said latch means to accommodate movement of said shackle between its first and more depressed positions while maintaining the engagement of said one leg by said latch means.

10. A padlock as recited in claim 8 wherein:

said means associated with the short shackle leg comprises switch means located in the receiving means for the short leg.

11. A padlock as recited in claim 1 wherein:

said latch means comprises means, responsive to the authorized operation of said lock means, for engaging said long leg to retain the long leg in said body when the short leg is outside the body.

12. A padlock as recited in claim 11 wherein:

said latch means comprises first engaging means for engaging said short leg when the latter is in its receiving means and the shackle is in its first depressed position and second engaging means for engaging said long leg when the shackle is in its extended, open position.

13. A padlock as recited in claim 12 and comprising:

means mounting said latch means for reciprocal movement between a first position wherein said latch means is engageable with said short leg but not said long leg and a second position wherein the latch means is engageable with the long leg but not the short leg;

means normally urging the latch means to its first position;

said means responsive to the authorized operation of the lock means comprises means for moving the latch means to its second position;

means on the long leg for engaging the latch means when the latch means is in its second position and the shackle is in its extended, open position;

said last recited means comprising means for disengaging the latch means to permit the latch means to return to its first position, in response to movement of the shackle to its first depressed position.

14. A padlock as recited in claim 12 wherein:

said long leg comprises an elongated peripheral indentation having an inner end and comprising means for receiving the latch's second engaging means when the latch is in its second position;

and said engaging means on the long leg comprises a peripheral lip extending in an axially outward direction at said inner end of the indentation.

15. A padlock with a tamper alarm, said padlock comprising:

a body;

a shackle having a long leg and a short leg;

means mounting said shackle for reciprocal movement thereof relative to said body, between an extended, open position, in which said short shackle leg is outside the body, and a depressed position for the shackle;

means in said body for receiving each of said shackle legs;

means normally urging said shackle to its extended position;

latch means for engaging one of said shackle legs when the shackle is in its depressed position and said short leg is inside the shackle body;

lock means operable to disengage said latch means from said one shackle leg;

alarm means actuable to emit an alarm signal;

a compartment in said body for containing a battery to provide energy for said alarm means;

an entry to said compartment for gaining access to a battery therein;

a removable cap for closing said entry;

and removable fastener means, accessible solely through said receiving means for said short leg, for engaging said cap to prevent removal of the cap from said entry;

said short leg comprising means for blocking access to said fastener means when said short leg is in its receiving means.

16. A padlock with a tamper alarm, said padlock comprising;

a body;

a shackle having a long leg and a short leg;

means mounting said shackle for reciprocal movement thereof relative to said body, between an extended, open position, in which said short shackle leg is outside the body, and a depressed position for the shackle;

means in said body for receiving each of said shackle legs;

means normally urging said shackle to its extended position;

latch means for engaging one of said shackle legs when the shackle is in its depressed position and said short leg is inside the shackle body;

lock means operable to disengage said latch means from said one shackle leg;

audible alarm means actuable between an on condition for sounding an alarm and a normally off condition;

means in said body for containing said alarm means;

and means for actuating said audible alarm means to its on condition in response to a violation of said padlock;

said receiving means for the other shackle leg communicating with said means for containing the alarm means and comprising means defining a sound port for said audible alarm means when said other shackle leg is outside of its receiving means.

17. A padlock as recited in claim 16 wherein said means for actuating the alarm means in response to a violation comprises means for doing so in response to one of:

(a) severance of the shackle; and (b) forced removal of the other shackle leg from its receiving means.

18. A padlock as recited in claim 17 and comprising:

means for ejecting said other leg totally from its receiving means in response to severance of the shackle.

19. A padlock as recited in claim 18 and comprising:

means for retaining said other leg in its receiving means in response to authorized operation of said lock means.

20. A padlock as recited in claim 18 wherein:

said ejecting means also comprises said means normally urging said shackle toward its extended, open position.

21. A padlock as recited in claim 17 wherein:

said latch means comprises means, responsive to the authorized operation of said lock means, for engaging said long leg to retain the long leg in said body when the short leg is outside the body.

22. A padlock as recited in claim 21 wherein:

said latch means comprises first engaging means for engaging said short leg when the latter is in its receiving means and the shackle is in its first depressed position and second engaging means for engaging said long leg when the shackle is in its extended, open position.

23. A padlock as recited in claim 22 and comprising:

means mounting said latch means for reciprocal movement between a first position wherein said latch means is engageable with said short leg but not said long leg and a second position wherein the latch means is engageable with the long leg but not the short leg;

means normally urging the latch means to its first position;

said means responsive to the authorized operation of the lock means comprising means for moving the latch means to its second position;

means on the long leg for engaging the latch means when the latch means is in its second position and the shackle is in its extended, open position;

said last recited means comprising means for disengaging the latch means to permit the latch means to return to its first position, in response to movement of the shackle to its first depressed, position.

24. A padlock with a tamper alarm, said padlock comprising:

a lock body;

a shackle having a long leg and a short leg;

means mounting said shackle for reciprocal movement thereof relative to said body, between an extended open position in which said short shackle let is outside the body, and a depressed position for the shackle;

means in said body for receiving each of said shackle legs;

means normally urging said shackle to its extended position;

latch means for engaging one of said shackle legs when the shackle is in its depressed position and said short leg is inside the shackle body;

lock means operable to disengage said latch means from said one shackle leg;

alarm means actuable between an on condition for emitting an alarm signal and an off condition;

means for maintaining said alarm means in said off condition during authorized operation of the lock means;

means for containing a battery;

an electrical circuit including first and second switch means;

means for maintaining said first switch means in an open position and said second switch means in a closed position when said shackle is in its depressed position and the short leg is inside the lock body;

said electrical circuit comprising means for actuating said alarm means to its on condition and for maintaining the alarm means in its on condition while the first switch means is open, following the momentary closure of the first switch means while the second switch means remains closed;

and means responsive to movement of the other shackle leg from its depressed to its extended position for monetarily closing and then opening said first switch means.

25. A padlock as recited in claim 24 wherein said means for maintaining the alarm means in its off condition during authorized operation of the lock means comprises:

means, responsive to the authorized operation of the lock means, for opening the second switch means before the first switch means is momentarily closed.

26. A padlock as recited in claim 24 wherein:

said means for maintaining the second switch means in a closed disposition comprises means associated with said one shackle leg.

27. A padlock as recited in claim 26 wherein:

said one leg is the short leg and said other leg is the long leg.

28. A padlock as recited in claim 27 and comprising:

means mounting said shackle for pivotal movement, when the shackle is in its extended, open position, between a first disposition in which said short leg is aligned with said receiving means in the lock body and a second disposition in which said short leg is clear of said body;

said mounting means for the shackle comprising means mounting said long leg for movement between said first-recited depressed position and a second depressed position, more depressed than said first-recited depressed position, when said short leg is outside the lock body and in its second pivotal disposition;

said electrical circuit comprising means for returning the alarm means to its off condition in response to depression of said long shackle leg to its second depressed position.

29. A padlock as recited in claim 28 wherein said electrical circuit comprises:

means for actuating said alarm means to its on condition in response to a violation of said padlock comprising one of (a) severance of the shackle and (b) forced removal of the long leg from its receiving means;

and means for maintaining said alarm means in an on condition upon authorized operation of said lock means, following a violation, in the absence of a subsequent depression of said long shackle leg to its second depressed condition.

30. A padlock as recited in claim 28 wherein:

said electrical circuit comprises means, including said first and second switch means for returning said alarm means to its on condition, following the depression of said long leg to its second depressed position, upon the release of said long leg and its subsequent movement to its extended position, in the absence of a prior authorized operation of said lock means.

31. A padlock as recited in claim 30 and comprising:

means for opening the second switch means in response to an authorized operation of said lock means.

32. A padlock as recited in claim 28 wherein said means for returning said alarm means to its off condition comprises:

a third switch closeable by said long leg when the latter is in its second depressed position.

33. A padlock as recited in claim 24 wherein said first switch means comprises:

a resilient switch element extending into the receiving means for said other shackle leg alongside said other shackle leg but normally not touching said other leg;

and another switch element extending radially outwardly from said other leg for momentary engagement with said one switch element as said other shackle leg moves from its depressed to its extended position.

34. A padlock as recited in claim 33 wherein:

said other switch element is located at the inner end of said other shackle leg.

35. A padlock as recited in claim 24 wherein said second switch means comprises:

a first switch element located axially inwardly of the inner end of said one leg;

and a resilient second switch element located between said first switch element and said one leg's inner end.

36. A padlock as recited in claim 35 wherein said means for maintaining the second switch means in a closed position comprises:

an elongated pin having a pair of opposed ends;

guide means mounting said pin for movement in the same direction as the one leg moves;

said pin comprising means at one end of the pin for engaging said inner end of the one leg when the shackle is in its depressed position;

said pin further comprising means at the other end of the pin, opposite its one end, for engaging said resilient switch element to depress the latter into contact with said first switch element, to close the second switch, when said other end of the pin is engaged by said inner end of the one leg and the latter is in its depressed position.

37. A padlock as recited in claim 36 wherein:

said electrical circuit comprises a further switch element located axially inwardly of said first switch element;

said mounting means for the shackle comprises means mounting the shackle for movement to a further depressed position more depressed than when the one leg is in its first-recited depressed position;

said latch means and said one leg comprising means cooperating to accommodate movement of the shackle to said further depressed position;

said first switch element is composed of resilient material to faciliate depression thereof into contact with said further switch element in response to said further depression of said one leg;

and said electrical circuit comprises means for actuating said alarm in response to said contact between said first switch element and said further switch element.

38. A padlock as recited in claim 24 wherein:

said alarm means comprises at least one of an audible-signal emitting element, an inaudible-signal emitting element and a combination of the two.

39. A padlock as recited in claim 24 wherein:

said alarm means comprises an audible-signal emitting element;

and said lock body comprises at least one sound port through which said audible signal exits from within the lock body.

40. A padlock as recited in claim 39 wherein:

said lock body has a plurality of sides and opposite ends;

and a sound port is located in at least one of a lock body side and a lock body end.

41. A padlock as recited in claim 39 wherein:

said sound port comprises one of said shackle leg receiving means.

* * * * *

UNITED STATES PATENT AND TRADEMARK OFFICE

CERTIFICATE OF CORRECTION

PATENT NO. : 4,811,578

DATED : March 14, 1989

INVENTOR(S) : Masoncup, et al.

It is certified that error appears in the above-identified patent and that said Letters Patent is hereby corrected as shown below:

Col. 9, line 51, change "position" to --positions--;

Col. 13, line 49, change "monetarily" to --momentarily--.

Signed and Sealed this

Twenty-fourth Day of October, 1989

*Attest:*

DONALD J. QUIGG

*Attesting Officer*

*Commissioner of Patents and Trademarks*